US010900689B2

(12) United States Patent
Weiner

(10) Patent No.: US 10,900,689 B2
(45) Date of Patent: Jan. 26, 2021

(54) WINDOW AIR CONDITIONER SUPPORT APPARATUS AND METHOD

(71) Applicant: Jay M. Weiner, Boston, MA (US)

(72) Inventor: Jay M. Weiner, Boston, MA (US)

( * ) Notice: Subject to any disclaimer, the term of this patent is extended or adjusted under 35 U.S.C. 154(b) by 208 days.

(21) Appl. No.: 16/117,725

(22) Filed: Aug. 30, 2018

(65) Prior Publication Data

US 2020/0072496 A1 Mar. 5, 2020

(51) Int. Cl.
*F24F 13/32* (2006.01)
*F24F 1/027* (2019.01)

(52) U.S. Cl.
CPC ..... *F24F 13/32* (2013.01); *F24F 1/027* (2013.01)

(58) Field of Classification Search
CPC ..... F24F 13/32; F24F 1/027
USPC ..... 454/204
See application file for complete search history.

(56) References Cited

U.S. PATENT DOCUMENTS

| | | | |
|---|---|---|---|
| 3,911,803 | A | 10/1975 | Kong et al. |
| 4,510,852 | A | 4/1985 | Sorrentino |
| 5,979,533 | A | 11/1999 | Dupuie |
| 6,767,278 | B1 | 7/2004 | Peterson |
| 2007/0023592 | A1 | 2/2007 | Makoso |
| 2013/0153744 | A1 | 6/2013 | Jin et al. |

*Primary Examiner* — Steven B McAllister
*Assistant Examiner* — Allen R Schult
(74) *Attorney, Agent, or Firm* — Davis Malm & D'Agostine, PC; Richard L. Sampson

(57) ABSTRACT

A support for mounting an air conditioner for operative disposition in a window, while being free of any supports external to the window and of any metallic contact with the window, includes elongated top and bottom members of lightweight polymeric molded construction, sized and shaped to extend along an interior window sill of the window, with opposite ends thereof extending beyond vertical side jambs of the window. First and second transverse members of polymeric molded construction extend between the top and bottom members to define a receptacle sized and shaped to slidably receive the air conditioner therein and to interferingly engage an elongated flange extending along an upper surface of the air conditioner. The top and bottom members include molded hand-holds and demarcations/score lines to facilitate trimming to desired widths.

16 Claims, 5 Drawing Sheets

WINDOW AIR CONDITIONER SUPPORT APPARATUS AND METHOD

BACKGROUND

Technical Field

This invention relates to window air conditioners, and more particularly to a support that facilitates installation and removal of the air conditioner from a window.

Background Information

Window air conditioners are routinely installed in double-hung windows by opening the lower sash of the window, resting the air conditioner on the window sill, and then lowering the window sash. In this scenario, one person typically holds the air conditioner in place on the sill while another person lowers the sash into engagement with the air conditioner. The sash is thus used to secure the air conditioner in place. It will be recognized that this approach tends to be cumbersome and may be dangerous, e.g., if the sash is inadvertently moved upwards without otherwise securing the air conditioner.

A wide variety of mounting and support assemblies for window-type air conditioners have been devised in an effort to enhance such installation. Conventional approaches include any number of braces and supports that are mechanically fastened to both the air conditioner and the jamb/casings of the window into which the air conditioner is to be installed. Supports may also be provided outside the window, extending beneath the air conditioner to an exterior window sill or secured to an exterior building façade with mechanical fasteners such as screws or bolts. Drawbacks associated with many of these approaches include relatively time consuming and complex multi-component installations, and the need for mechanical fasteners that tend to be unsightly and require undesirable penetrations into window moldings/casings and/or building facades. Conventional approaches also typically place metallic components of the braces and/or air conditioners in positions where they contact and potentially scratch or otherwise damage woodwork such as window moldings and casings.

Still other potential drawbacks include the need for components of the brace/support to be installed before placing the air conditioner unit thereon. This approach is often complicated, requiring external access to the window by ladder. These pre-installed approaches also generally fail to address the problem of lifting the air conditioner into the window and onto the brace/support, which tends to be cumbersome and often requires at least two people to complete.

Thus, a need exists for a system and method that addresses the aforementioned drawbacks.

SUMMARY

The appended claims may serve as a summary of the invention. The features and advantages described herein are not all-inclusive and various embodiments may include some, none, or all of the enumerated advantages. Additionally, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

The present invention is illustrated by way of example and not limitation in the figures of the accompanying drawings, in which like references indicate similar elements and in which.

DETAILED DESCRIPTION

Figure 1A:
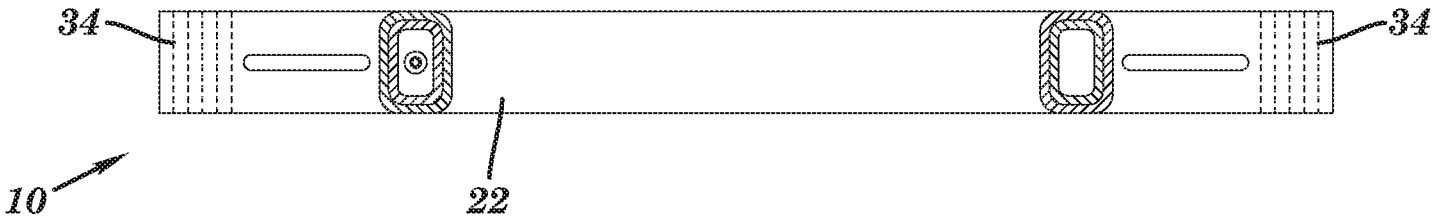
FIG. 1A is a top plan view of an embodiment of the present invention.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below. Additionally, unless otherwise specifically noted, articles depicted in the drawings are not necessarily drawn to scale. In addition, well-known structures, circuits and techniques have not been shown in detail in order not to obscure the understanding of this description. The following detailed description is, therefore, not to be taken in a limiting sense, and the scope of the present invention is defined by the appended claims and their equivalents.

General Overview

Figure 1B:
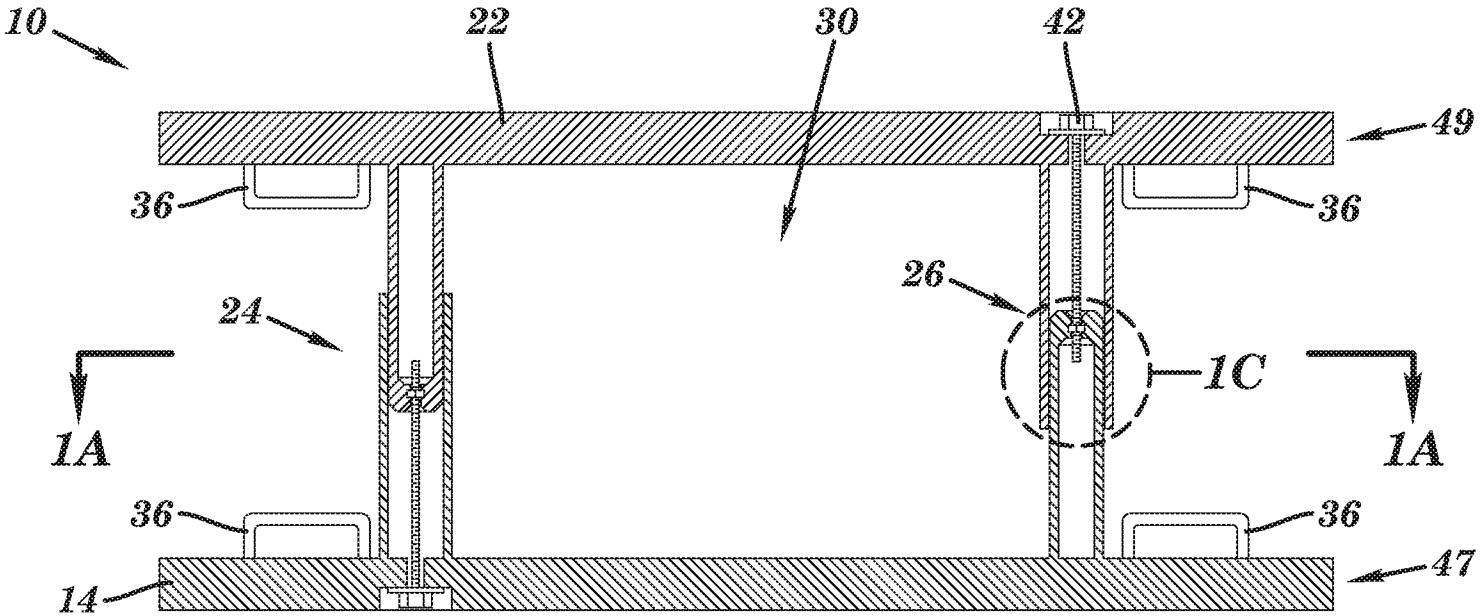
FIG. 1B is an elevational side view of the embodiment of FIG. 1A.
Figure 1C:
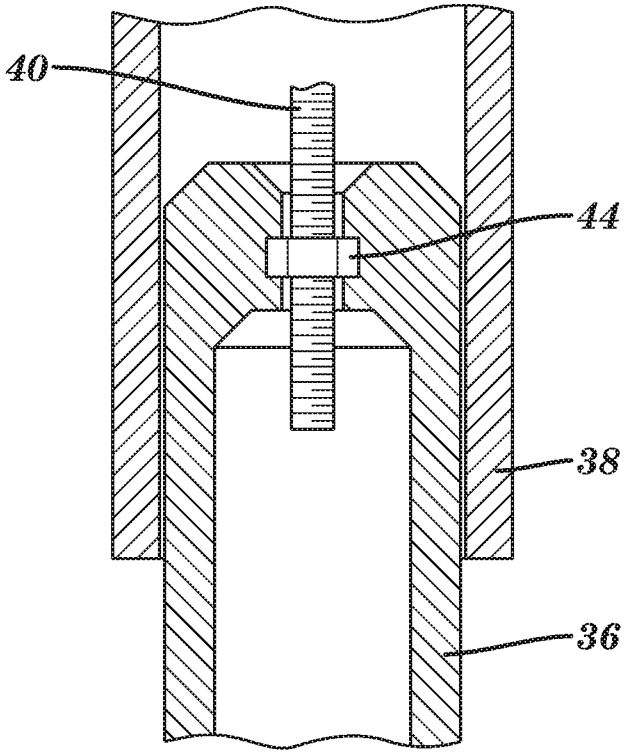
FIG. 1C is an enlarged view of a portion of the embodiment of FIG. 1B.
Figure 2:
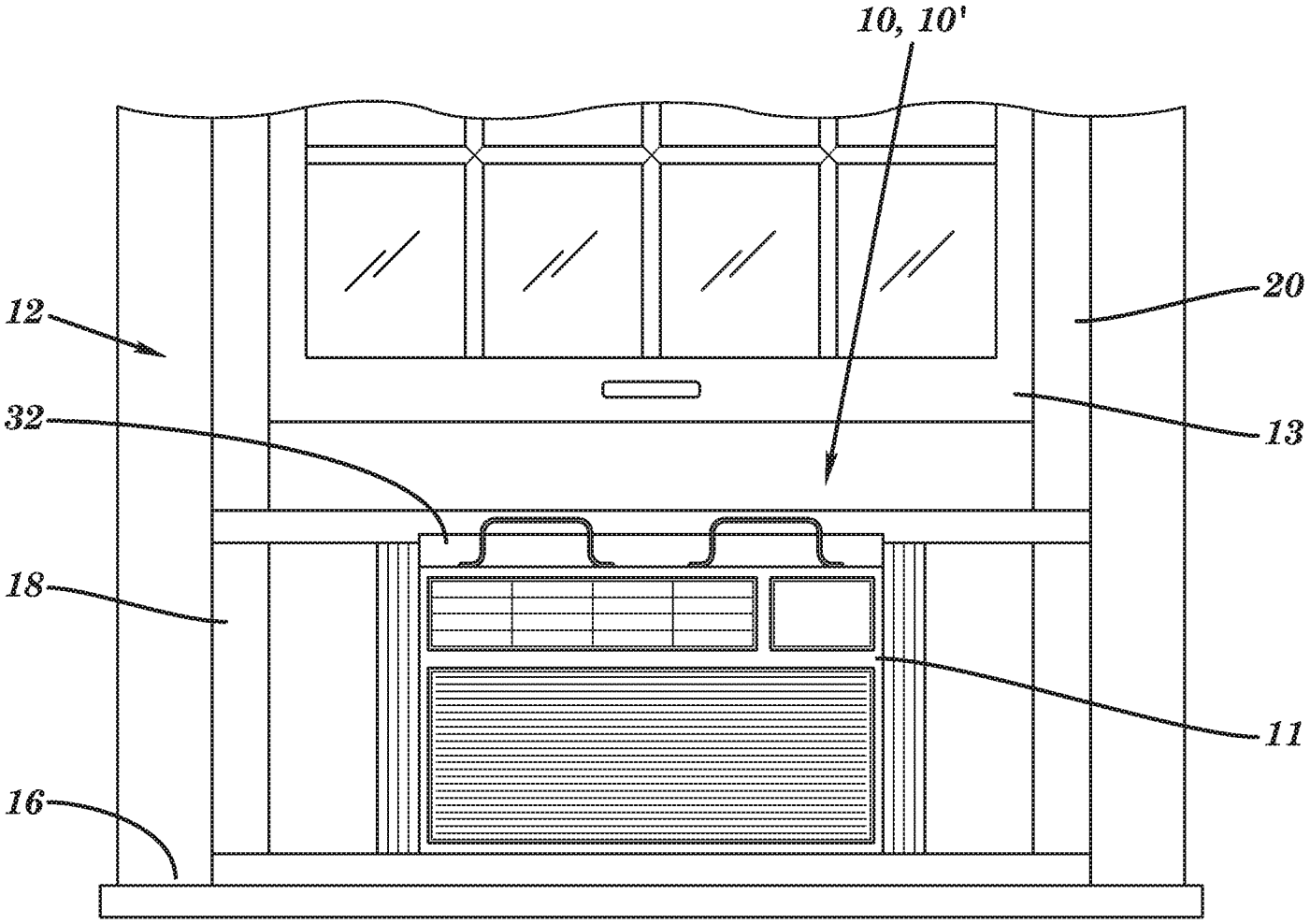
FIG. 2 is a view similar to that of FIG. 1B, in a typical installation.
Figure 3:
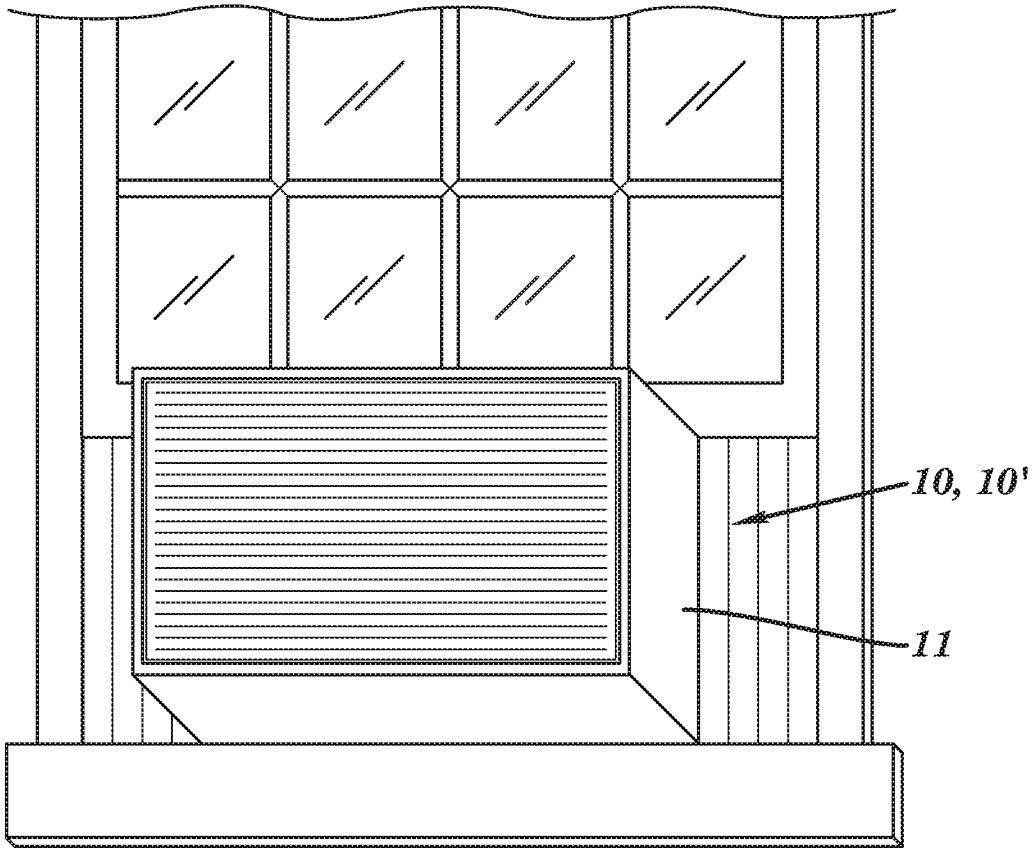
FIG. 3 is a perspective rear view of the installation of FIG. 2.
Figure 4A:
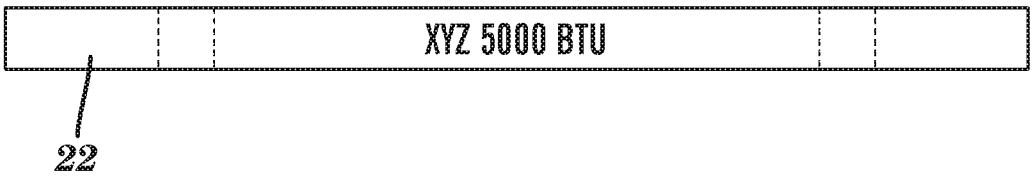
FIG. 4A is a top plan view of an alternate embodiment of the present invention.
Figure 4B:
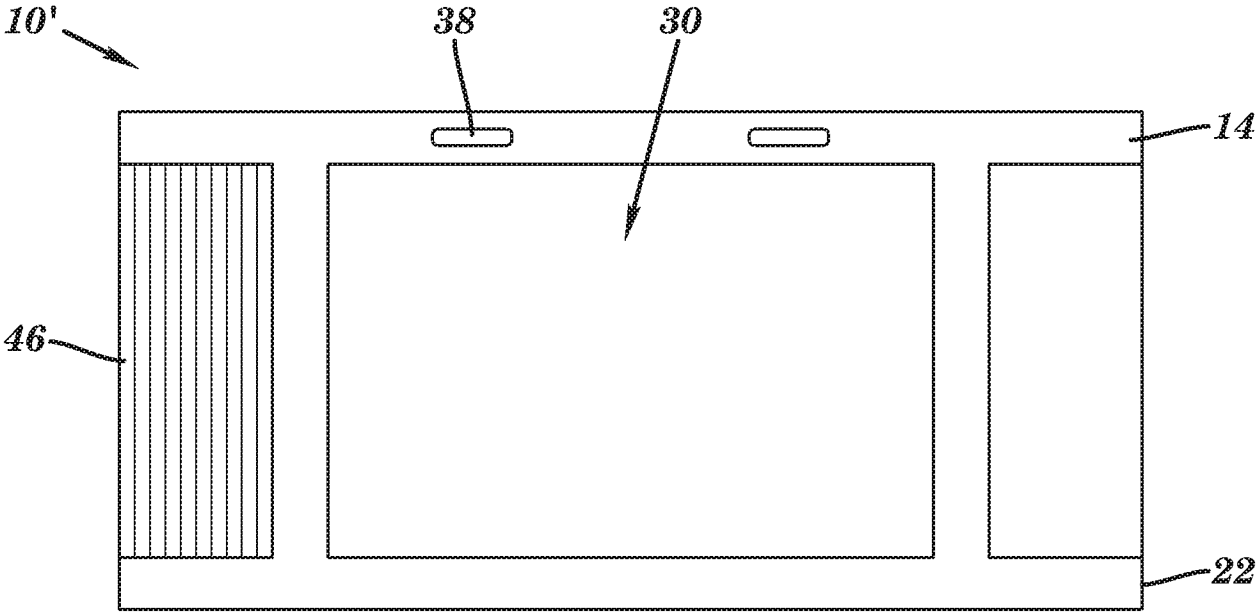
FIG. 4B is an elevational side view of the embodiment of FIG. 4A.

Embodiments of the invention include a support that facilitates installation and removal of an air conditioner from a window. Referring to FIGS. 1A-1C, in one embodiment, the support includes two horizontal members connected to one another with adjustable cross-members that enable the support to be clamped onto a window air conditioner as shown in FIG. 2. As also shown in FIG. 2, the horizontal members are long enough to engage the window frame, so that the user may simply place the air conditioner with the support into the window opening, where the weight of the air conditioner will hold the horizontal members against the window frame. The user may therefore easily place the air conditioner into the window without having to hold it in place, and without the need, as used in the prior art, to use the window sash to keep the air conditioner from falling out the window. These embodiments thus also eliminate the need for a second person to lower the sash while a first person holds the air conditioner in place in the window. As shown in FIG. 3, the support securely holds the air conditioner in place within the window opening without resting on the exterior window sill, and without the need for an exterior brace. As shown in FIG. 4, in an alternate embodiment, the support may be fabricated as a one-piece unit, e.g., from a structural polymer such as polyethylene (PE) or low-density polyethylene (LDPE) sized and shaped for specific makes and models of air conditioners.

Terminology

As used in the specification and in the appended claims, the singular forms "a", "an", and "the" include plural referents unless the context clearly indicates otherwise. For example, reference to "a member" includes a plurality of such members.

Although specific terms are employed herein, they are used in a generic and descriptive sense only and not for purposes of limitation. All terms, including technical and scientific terms, as used herein, have the same meaning as commonly understood by one of ordinary skill in the art to which this invention belongs unless a term has been otherwise defined. It will be further understood that terms, such as those defined in commonly used dictionaries, should be interpreted as having a meaning as commonly understood by a person having ordinary skill in the art to which this invention belongs. It will be further understood that terms, such as those defined in commonly used dictionaries, should be interpreted as having a meaning that is consistent with their meaning in the context of the relevant art and the present disclosure. Such commonly used terms will not be interpreted in an idealized or overly formal sense unless the disclosure herein expressly so defines otherwise.

An aspect of the present invention was the recognition by the present inventor that it would be desirable to provide an air conditioner support of relatively simple, substantially one-piece molded construction, with custom dimensions to receive particular air conditioner units therein, and/or with some adjustability to accommodate a range of air conditioners. It was further realized that although conventional wisdom may teach against the idea of relying on end-users to make significant modifications in the field, demarcations and/or score lines on plastic components may be used to make such field modifications simple and relatively error-free. The present inventor also recognized, contrary to conventional wisdom, that a substantially one-piece plastic construction would have sufficient structural integrity to support an air conditioner, even without exterior braces fastened to the window sill or building façade. It was still further recognized that eliminating the need for exterior supports would enable the support to be pre-installed onto the air conditioner, and then used to lift and slide the air conditioner into place in the window.

Referring now to the Figures, embodiments of the present invention will be more thoroughly described. Turning now to FIGS. 1A-1C, an apparatus, in the form of a support 10, is used to mount an air conditioner 11 for operative disposition with respect to a window 12 (FIG. 2) having a moveable sash 13, while being free of any supports external to the window, while also being free of metallic contact with the window. As shown, support 10 includes an elongated bottom member 14 of polymeric molded construction, sized and shaped to extend along an interior window sill 16 (FIG. 2) of the window 12, with opposite ends thereof extending beyond vertical side jambs 18, 20 of the window.

Support 10 also includes an elongated top member 22 of polymeric (e.g., molded) construction, sized and shaped to extend in superposed orientation with the bottom member 14, with opposite ends thereof extending beyond the vertical side jambs 18, 20 of the window. First and second transverse members 24, 26 of polymeric construction, extend in spaced relation to one another between the bottom member 14 and top member 22, wherein the transverse members 24, 26, the bottom member 14, and the top member 22 define a receptacle 30 (FIG. 1B) sized and shaped to slidably receive the air conditioner therein and to interferingly engage an elongated flange 32 (FIG. 2) extending along an upper surface of the air conditioner. As shown in FIGS. 2 and 3, the receptacle 30 is sized and shaped to extend 360 degrees about a vertical cross-section taken through the air conditioner when the air conditioner is disposed in its operative orientation.

As shown in FIG. 1A, demarcations and/or score lines 34 are molded into at least one of bottom member 14 and top member 22 to facilitate trimming the opposite ends to accommodate windows of various widths. In this regard, the opposite ends may be trimmed as desired to provide members 14 and/or 22 with sufficient overlap with vertical side jambs 18, 20 as shown in FIG. 2 to prevent the support 10 from sliding out the window, without the members being so long as to be unsightly or to otherwise interfere with architectural features such as window trim. Particular embodiments of support 10 also include a plurality of hand-holds 36 (FIG. 1B) or 38 (FIG. 4) molded into at least one of the members 14, 22.

These embodiments form a unitary, lightweight polymeric air conditioner support 10 being free of any exposed metallic components, with hand-holds 36, 38 graspable by a user to lift and extend the air conditioner 11 out the window 12, as shown in FIG. 3, until the bottom member 14 rests on the window sill 16 and the opposite ends of at least one of the bottom member 14 and the top member 22 engage the vertical jambs and/or casings 18, 20 of the window, as shown in FIG. 2. Once so positioned, the weight of the air conditioner extending outside the window maintains the ends of at least one of the members 14, 22 in surface to surface engagement with the vertical side jambs and/or casings 18, 20 to maintain the air conditioner 12 in operative disposition with the window 12 independently of the movable sash 13. In other words, the support 10 maintains the air conditioner 11 within the open window 12, without having to rely on leaning the flange 32 against the sash 13. This tends to simplify and improve the safety of installing the air conditioner into the window relative to conventional approaches, since it enables the sash 13 to be open widely during installation, e.g., as shown in FIG. 2. The ability to widely open the sash provides ample clearance to install the air conditioner without scraping or otherwise damaging the sash or other window components without risk of the air conditioner falling out the window. Moreover, support 10 provides these features without the need for any supports external (i.e., exterior) to the window, and without the need for any metallic contact with the window either in the form of metallic components resting against the window or in the form of screws or other mechanical fasteners anchored to the window or the surrounding building structure.

In various embodiments, the transverse members 24, 26, and the bottom and top members 14, 22, are fabricated from structural polymers such as polyethylene, polypropylene, polystyrene, polyvinyl chloride, and mixtures and combinations thereof. For example, these members may be molded with a corrugated or honeycomb core to provide the requisite structural rigidity.

It should be recognized that embodiments of the present invention may be fabricated as substantially unitary, molded components, in which the top, bottom, and transverse members are molded as a single component as shown in FIG. 4 as support 10'. As discussed herein, such unitary plastic construction provides relatively light weight while having sufficient structural rigidity to enable it to be used to lift an air conditioner into and out of a window, and to support the air conditioner within the window during use. The plastic construction also helps to prevent damage to the window that may otherwise be caused by metallic components scratching painted trim or by drilling and/or screwing anchors into window jambs, sills, or building facades. In these one-piece embodiments, support 10' may be provided with a receptacle 30 sized and shaped for specific makes and models of air conditioners. The particular make and model may also be permanently affixed, such as by molding or embossing, into one of the members such as into top member 22 as shown in FIG. 4.

Referring back to FIGS. 1B and 1C, in some embodiments the transverse members 24 and 26 may be fabricated as telescopingly adjustable components with internally captured and/or recessed fasteners, to permit the transverse members to be tightened to clamp the transverse members 24 and 26 to the air conditioner 11. For example, each member 24, 26 may include telescoping inner and outer tubes 36 and 38 which are adjustable by use of a threaded fastener 40 with a head 42 countersunk in one of the members 14, 22, and which extends through one of the tubes 36, 38 to a nut 44 captured in the other of the tubes 36, 38. In this regard, the nut 44 may be molded in-situ in one end of the tube as shown, or may be placed into the tube from the opposite end thereof. The fastener 40 may be loosened to facilitate receiving the air conditioner 11 into receptacle 30 and into engagement with the elongated flange 32 as shown in FIG. 2. The user may then tighten fastener 40 to effectively clamp members 14, 22 onto the air conditioner to secure the support 10 to the air conditioner. In this manner, support 10 has characteristics of the aforementioned unitary molded construction (support 10'), including being free of any external metallic components, while also being adjustable to accommodate air conditioners 11 of various sizes. This support 10 may thus be viewed as having an adjustable, unitary molded construction.

Indeed, like the embodiment of FIG. 4, support 10 may be molded from a single mold. In this regard, it should be noted that as shown, support 10 may be fabricated from two substantially identical components that are fastened to one another after inverting one into the other. For example, in the embodiment shown, bottom member 14 may be molded integrally with the outer telescoping tube of member 24, and with the inner telescoping tube of member 26, along with in-situ nut 44, to form a lower assembly 47. A copy of this assembly 47 may then be simply inverted to form an upper assembly 49, including top member 22 and the remaining telescoping tubes of members 24 and 26. Since the upper assembly is effectively a mirror image of the lower assembly, both of these assemblies 47, 49 may be fabricated using a single mold, to simplify manufacture and inventory requirements. Final assembly then simply involves fastening assemblies 47, 49 to one another using the threaded fasteners 40.

As best shown in FIG. 4, in particular embodiments, supports 10, 10' are provided with a web 46, e.g., fabricated from plastic materials similar to those used to fabricate the support 10, 10', extending between the top member and the bottom member outside of the receptacle 30 to form an ambient air barrier between the receptacle 30 and the vertical side jambs 18, 20, when installed into a window. Web 46 is thus configured to be coextensive with ends of the top member and the bottom member effectively close the gap between the receptacle 30 and jambs 18, 20. The web may be adjustable, such as provided by configuration as an accordion style baffle. Alternatively, the web 46 may take the form of plastic sheets that are slidable relative to one another to provide adjustability. Still further, the web 46 may take the form of one or more plastic sheets that are adjustable by being trimmed, e.g., using scissors or the like.

Turning now to the following Table I, a method of fabricating support 10, 10' is shown and described.

| | |
|---|---|
| 52 | Bottom member 22 sized and shaped |
| 54 | Top member 14 sized and shaped |
| 56 | Transverse members 24, 26 extended between members 22, 14 |
| 58 | demarcations/score lines 34 are molded |
| 60 | hand-holds 36, 38 are molded |
| 62 | Optionally, use polyethylene, polypropylene, polystyrene, polyvinyl chloride, and mixtures and combinations thereof |
| 64 | Optionally mold the support as a unitary, one-piece construction |
| 66 | Optionally fabricate transverse members 24, 26 to be telescopingly adjustable with internally captured and/or recessed fasteners |
| 68 | Optionally extend polymeric web 46 |
| 70 | Optionally provide web with adjustability |

Method 50 includes sizing and shaping 52 the bottom member 22 to extend along an interior window sill of the window, with opposite ends thereof extending beyond vertical side jambs of the window. At 54, top member 14 is sized and shaped to extend in superposed orientation with the bottom member, with opposite ends thereof extending beyond the vertical side jambs of the window. At 56, first and second transverse members 24, 26 are extended in spaced relation to one another between the bottom and top members 22, 14, to define the receptacle 30. At 58, the demarcations/score lines 34 are molded into at least one of the members 22, 14 to facilitate trimming to accommodate windows of various widths. A plurality of hand-holds 36, 38 are molded 60 into at least one of the members 22, 14, wherein the apparatus forms a unitary, lightweight polymeric air conditioner support being free of any exposed metallic components, with hand-holds graspable by a user to lift and extend the air conditioner out the window opening until the bottom member rests on the window sill and the opposite ends of at least one of the top and bottom members engage the vertical jambs and/or casings of the window so that weight of the air conditioner extending outside the window maintains the ends of at least the top member in surface to surface engagement with the vertical side jambs and/or casings to maintain the air conditioner in operative disposition with the window independently of the movable sash, while being free of any supports external to the window and being free of any metallic contact with the window.

Optional aspects of method 50 include molding 62 the support 10, 10' from structural polymers selected from the group consisting of polyethylene, polypropylene, polystyrene, polyvinyl chloride, and mixtures and combinations thereof, and optionally molding 64 the support as a unitary, one-piece construction. At 66, transverse members 24, 26 are fabricated to be telescopingly adjustable with internally captured and/or recessed fasteners, to provide the support with adjustable, unitary molded construction. At 68, a polymeric web 46 is extended between the top member and the bottom member outside of said receptacle to form an ambient air barrier between the receptacle and the vertical side jambs of the window. At 70, the web is fabricated to be adjustable, e.g., as an accordion style baffle or overlapping sheets, or by being trimmable.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. It should be further understood that any of the features described with respect to one of the embodiments described herein may be similarly applied to any of the other embodiments described herein without departing from the scope of the present invention. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. An apparatus for mounting an air conditioner for operative disposition with respect to a window having a moveable sash, while being free of any supports external to the window and of any metallic contact with the window, the apparatus comprising:

a) an elongated bottom member of polymeric molded construction, sized and shaped to extend along an interior window sill of the window, with opposite ends thereof extending to overlap vertical side jambs of the window;

b) an elongated top member of polymeric molded construction, sized and shaped to extend in superposed orientation with the bottom member, with opposite ends thereof extending to overlap the vertical side jambs of the window;

c) first and second transverse members of polymeric molded construction, extending in spaced relation to one another between the bottom member and the top member, wherein the transverse members, the bottom member, and the top member define a receptacle sized and shaped to slidably receive the air conditioner therein and to interferingly engage an elongated flange extending along and fastened to an upper surface of the air conditioner so that the receptacle extends 360 degrees about a vertical cross-section taken through the air conditioner when the air conditioner is disposed in the air conditioner's operative orientation;

d) demarcations and/or score lines molded into at least one of the bottom member and the top member to facilitate trimming said opposite ends to accommodate windows of various widths;

e) a plurality of hand-holds molded into at least one of the bottom member and the top member;

f) wherein the apparatus forms a unitary, polymeric air conditioner support being free of any exposed metallic components, with the plurality of hand-holds graspable by a user to lift and extend the air conditioner out the window opening until the bottom member rests on the window sill and the opposite ends of at least one of the bottom member and the top member engage the vertical jambs and/or casings of the window so that weight of the air conditioner extending outside the window maintains the opposite ends of at least one of the bottom member and the top member in surface to surface engagement with the vertical side jambs and/or casings to maintain the air conditioner in operative disposition with the window independently of the movable sash, while being free of any supports external to the window and being free of any metallic contact with the window.

2. The apparatus of claim 1, wherein the transverse members, the bottom member, and the top member comprise structural polymers selected from a group consisting of polyethylene, polypropylene, polystyrene, polyvinyl chloride, and mixtures and combinations thereof.

3. The apparatus of claim 1, being of unitary, molded construction.

4. The apparatus of claim 3, wherein each of the first and second transverse members are telescopingly adjustable with internally captured and/or recessed fasteners, to permit the transverse members to be tightened to clamp the bottom member and the top member to the air conditioner upon receipt of the air conditioner within the receptacle and engagement with the elongated flange to form an adjustable, unitary molded construction.

5. The apparatus of claim 1, wherein the movable sash of the window is closeable into engagement with the top member, and the apparatus further comprises a polymeric web extending between the top member and the bottom member outside of said receptacle to form an ambient air barrier between the receptacle and the vertical side jambs of the window.

6. The apparatus of claim 5, wherein the polymeric web is adjustable.

7. The apparatus of claim 6, wherein the polymeric web comprises an accordion style baffle.

8. The apparatus of claim 6, wherein the polymeric web is trimmable to be coextensive with said opposite ends of the top member and the bottom member.

9. A method for fabricating an apparatus for mounting an air conditioner in operative disposition with respect to a window having a moveable sash, while being free of any supports external to the window and of any metallic contact with the window, the method comprising:

a) sizing and shaping an elongated bottom member of polymeric molded construction to extend along an interior window sill of the window, with opposite ends thereof extending to overlap vertical side jambs of the window;

b) sizing and shaping an elongated top member of polymeric molded construction, to extend in superposed orientation with the bottom member, with opposite ends thereof extending to overlap the vertical side jambs of the window;

c) extending first and second transverse members of polymeric molded construction, in spaced relation to one another between the bottom member and the top member, wherein the transverse members, the bottom member, and the top member define a receptacle sized and shaped to slidably receive the air conditioner therein and to interferingly engage an elongated flange extending along and fastened to an upper surface of the air conditioner so that the receptacle extends 360 degrees about a vertical cross-section taken through the air conditioner when the air conditioner is disposed in the air conditioner's operative orientation;

d) molding demarcations and/or score lines into at least one of the bottom member and the top member to facilitate trimming said opposite ends to accommodate windows of various widths;

e) molding a plurality of hand-holds into at least one of the bottom member and the top member;

f) wherein the apparatus forms a unitary, polymeric air conditioner support being free of any exposed metallic components, with the plurality of hand-holds graspable by a user to lift and extend the air conditioner out the window opening until the bottom member rests on the window sill and the opposite ends of at least one of the bottom member and the top member engage the vertical jambs and/or casings of the window so that weight of the air conditioner extending outside the window maintains the opposite ends of at least one of the bottom member and the top member in surface to surface engagement with the vertical side jambs and/or casings to maintain the air conditioner in operative disposition with the window independently of the movable sash, while being free of any supports external to the window and being free of any metallic contact with the window.

10. The method of claim 9, comprising molding the transverse members, the bottom member, and the top member from structural polymers selected from a group consisting of polyethylene, polypropylene, polystyrene, polyvinyl chloride, and mixtures and combinations thereof.

11. The method of claim 9, comprising fabricating the apparatus as a unitary, molded construction.

12. The method of claim 11, comprising fabricating each of the first and second transverse members to be telescopingly adjustable with internally captured and/or recessed fasteners, to permit the transverse members to be tightened to clamp the bottom member and the top member to the air conditioner upon receipt of the air conditioner within the receptacle and engagement with the elongated flange to form an adjustable, unitary molded construction.

13. The method of claim 9, wherein the movable sash of the window is closeable into engagement with the top member, and the method further comprises extending a polymeric web between the top member and the bottom member outside of said receptacle to form an ambient air barrier between the receptacle and the vertical side jambs of the window.

14. The method of claim 13, wherein the polymeric web is adjustable.

15. The method of claim 14, wherein the polymeric web comprises an accordion style baffle.

16. The method of claim 14, wherein the polymeric web is trimmable to be coextensive with said opposite ends of the top member and the bottom member.

* * * * *